US005867095A

United States Patent [19]

Klein et al.

[11] Patent Number: 5,867,095

[45] Date of Patent: Feb. 2, 1999

[54] MODULE TAMPER DETECTION CIRCUITRY

[75] Inventors: Jeffrey M. Klein; Cherie H. Wilkinson, both of Chicago; Steven L. Wiora, Sycamore, all of Ill.

[73] Assignee: Pittway Corporation, Chicago, Ill.

[21] Appl. No.: 911,685

[22] Filed: Aug. 15, 1997

[51] Int. Cl.[6] ..... G08B 21/00

[52] U.S. Cl. ..... 340/506; 340/529; 340/568; 340/628

[58] Field of Search ..... 340/506, 568, 340/693, 628, 547, 545, 555, 556, 529

[56] References Cited

U.S. PATENT DOCUMENTS

| | | | |
|---|---|---|---|
| 4,207,558 | 6/1980 | Kunzer | 340/524 |
| 4,282,519 | 8/1981 | Haglund et al. | 340/628 |
| 4,286,159 | 8/1981 | Kitta et al. | 250/381 |
| 4,287,515 | 9/1981 | Raber et al. | 340/584 |
| 4,394,655 | 7/1983 | Wynne et al. | 340/825.36 |
| 4,528,558 | 7/1985 | Steers et al. | 340/545 |
| 4,916,432 | 4/1990 | Tice et al. | 340/518 |
| 4,920,333 | 4/1990 | Barr et al. | 340/545 |
| 5,568,123 | 10/1996 | Derheim | 340/570 |
| 5,598,147 | 1/1997 | Mochizuki et al. | 340/628 |

*Primary Examiner*—Glen Swann
*Attorney, Agent, or Firm*—Rockey, Milnamow & Katz, Ltd.

[57] ABSTRACT

A detector tamper/trouble delay circuit incorporates a sensor which senses the presence or absence of a cover for the detector. When the cover is removed, the sensor triggers a delay element preset for predetermined time interval. If the cover is replaced during the time interval, no trouble or fault indicator is generated. If the cover remains off the detector for the entire time interval, a trouble or fault indicator will be generated. The indicator can be used by an alarm system control element or a stand alone trouble or fault indicator for producing a humanly perceptible representation of the existence of the fault or trouble condition.

27 Claims, 5 Drawing Sheets

MODULE TAMPER DETECTION CIRCUITRY

FIELD OF THE INVENTION

The invention pertains to supervisory circuits for use in monitoring systems. More particularly, the invention pertains to supervisory circuits for use in establishing an operational status of ambient condition detectors such as intrusion, thermal, fire or gas detectors.

BACKGROUND OF THE INVENTION

Monitoring systems for supervising the status of various conditions in a selected region are useful in protecting property and individuals in the region. Representative systems include premises mounting systems such as burglar detection or fire detection systems. One such system is disclosed and claimed in Tice et al. U.S. Pat. No. 4,916,432 entitled Smoke and Fire Detection System Communication.

In addition to monitoring the region, it is desirable for the system to be able to supervise its constituent components. Where ambient condition detectors are present, detector supervision circuits are useful. It would be preferable, however, if routine maintenance could be distinguished from a fault condition.

SUMMARY OF THE INVENTION

An electrical module includes tamper detection apparatus to sense the removal of a portion of a housing of the module or alternatively the removal of other structures associated with the module. The apparatus includes a sensor for detecting removal of the relevant element. One exemplary form of the element is a cover for module.

A delay circuit is provided which is coupled to the sensor. The delay circuit generates an output signal at a predetermined time interval after removal of the element. The output signal is indicative of the fact that the element was removed and not replaced on the module during the time interval.

In one aspect, the apparatus can be incorporated into an ambient condition detector with a removable cover. If the cover is removed during installation or maintenance, such as cleaning or testing, the delay circuit is triggered. In the event that the cover is not replaced during the predetermined time interval after the delay circuit has been triggered, an output status indicator is generated. This status indicator is indicative of the cover not having been replaced on the detector during the time interval.

In another aspect, the sensor incorporates a manually operable switch, or alternately, reed relay. Removal of the cover permits the switch to change state thereby opening or closing metallic contacts.

In yet another aspect, a solid state sensor could be used. In one form, the supervisory sensor can include a radiant energy sensor. Removal of the cover exposes the sensor to a source of radiant energy thereby providing a trigger to the delay circuit. Alternately, removal of the cover could open circuit a portion of the sensor thereby triggering the delay interval.

In one aspect, the detector can be implemented as a smoke detector. In one embodiment, the smoke detector can be a duct mountable detector which incorporates a removal cover.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
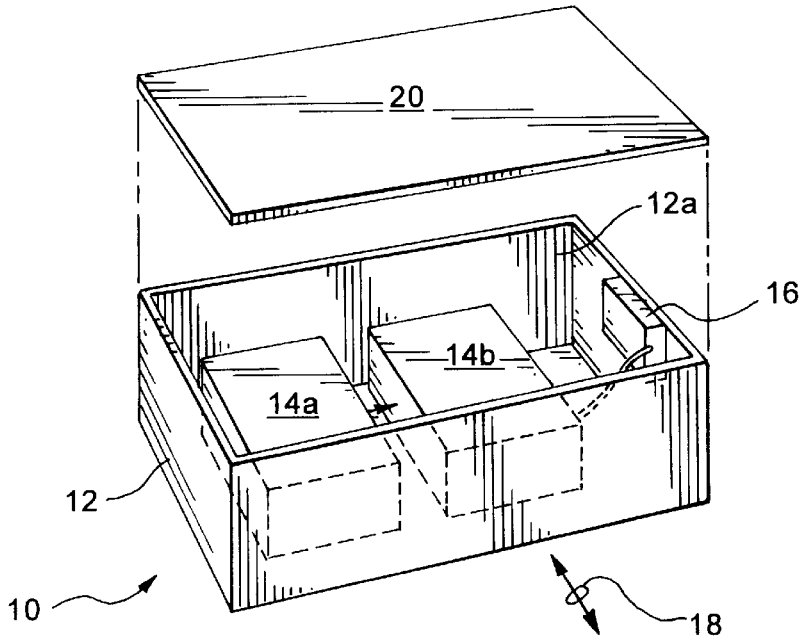
FIG. 1 is a perspective view of an electrical module having a removable cover and which incorporates supervision circuitry.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates an electrical module 10 which includes a housing 12. The housing 12 defines an interior region 12a wherein are located a transducer 14*a*, control circuitry 14*b* and a sensor 16. Electrical signals 18 are coupled to the module 10 for purposes of providing electrical energy and/or communicating information to or from the module.

The module 10 is closed by a removable cover 20 in a normal operation. For purposes of installation or maintenance including checking or cleaning the transducer 14*a* or testing the transducer or control element 14*a*, the cover 20 could be removed.

When the cover 20 is in place on the housing 12, sensor 16 which is coupled to the control element 14*b* exhibits a first state. Removal of the cover 20 results in the sensor 16 entering a second state which can be detected by the control element 14*b*.

The sensor 16 can incorporate for example a reed relay. Alternately, a manually operable spring loaded switch or a contactless sensor such as a photodetector could be used.

As will be appreciated by those of skill in the art, there are times when as a result of installation or routine maintenance, the cover 20 is not properly reinstalled on the module 10. In such an instance, the module 10 generates a supervisory fault or trouble indication a predetermined interval of time after the cover 20 has been removed. In normal installation or maintenance, once the module 10 has been connected and is operational or has been serviced the cover 20 will be reattached thereby resetting the control element or circuit 14*b* and blocking generation of the fault or trouble indicator.

As discussed subsequently, the control circuit 14*b* can incorporate a solid state programmable timer which is driven by a clock. The timer can be preset to a predetermined time interval, for example 20 minutes.

The timer can be triggered by removal of the cover 20. The timer can be reset by replacing the cover 20 on the module 10. In the event that the cover is not replaced, after the delay interval, the timer and control circuitry 14*b* will generate a detectable fault or trouble signal.

Figure 1A:
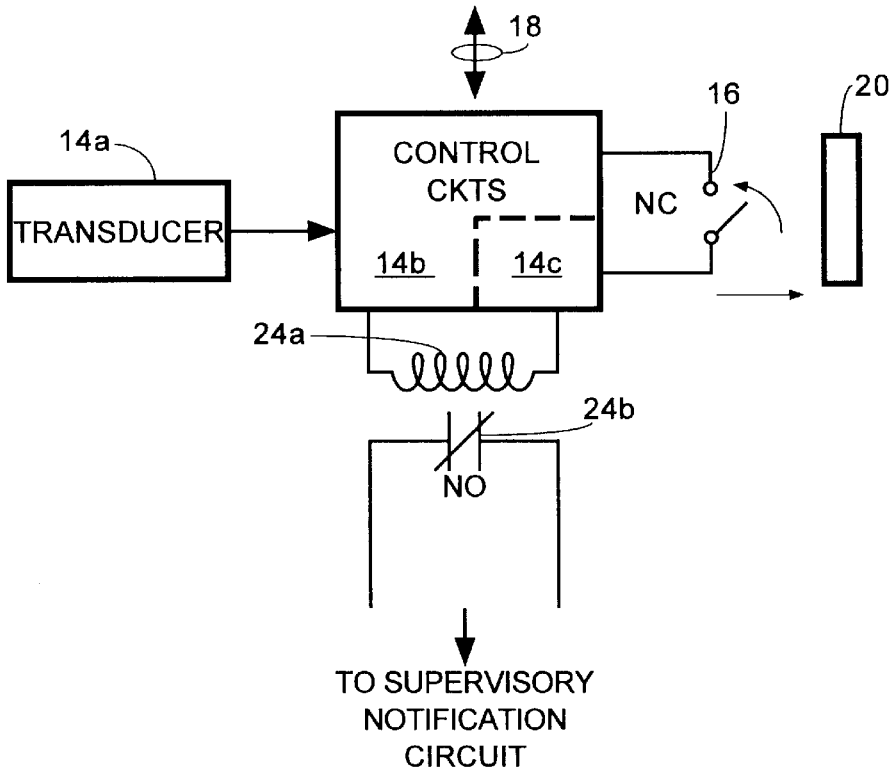
FIG. 1A is a block diagram of some of the electrical components of the module of FIG. 1.

As illustrated in FIG. 1A, control circuitry 14*b* can incorporate a normally open relay 24. The relay 24 includes a coil 24*a* and normally open contacts 24*b*.

Sensor 16, in FIG. 1A, is a normally closed manually operable switch or reed relay. In the presence of cover 20, the switch or relay is open which in turn causes control circuitry 14*b* to continuously energize coil 24*a* thereby holding normally open contacts 24*b* closed.

When the cover 20 is removed and the contacts of sensor 16 change state, solid state timer 14*c* is triggered. After a predetermined delay interval, assuming cover 20 has not been replaced in the interim, coil 24*a* is de-energized. This in turn enables contacts 24*b* to open providing a fault or trouble indicator. Alternately, instead of de-energizing coil 24*a*, circuitry 14*b* could provide a signal on communication lines 18, which signal would be received by a remote control unit and would indicate the presence of a trouble or supervisory condition.

Figure 2:
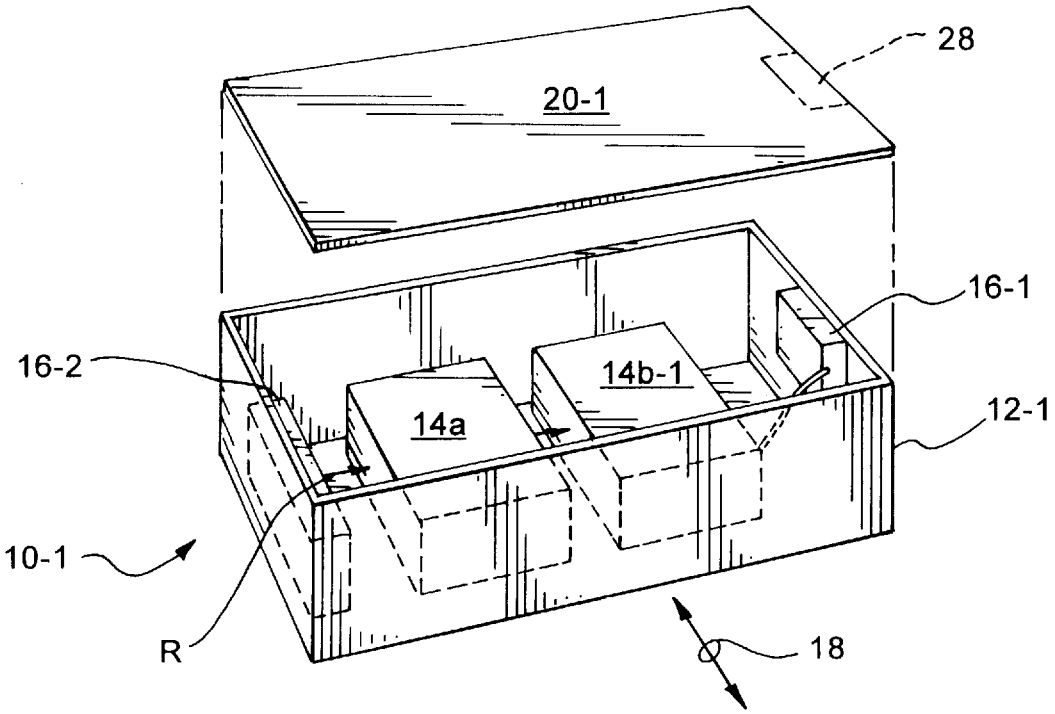
FIG. 2 is a perspective view of an alternate embodiment of an electrical module with a removable cover and supervision circuitry.

FIG. 2 illustrates an alternate module 10-1. The module 10-1 includes a housing 12-1.

Transducer 14*a* is carried within the housing 12-1 along with control circuitry 14*b*-1. The housing 12-1 incorporates a radiant energy sensor 16-1 which can be energized by radiant energy R generated by a source 16-2. While in the configuration illustrated in FIG. 2 the radiant energy R is directly incident on the sensor 16-1, it will be understood that other arrangements could be used without departing from the spirit and scope of the present invention.

The module 10-1 includes a cover 20-1 which closes the housing 12-1. In normal use, with the cover 20-1 attached, a shroud or enclosure 28 (illustrated in phantom in FIG. 2) blocks incident radiant energy R or radiant energy from any other source from falling upon sensor 16-1 and generating false indications that the cover 20-1 has been removed.

Figure 2A:
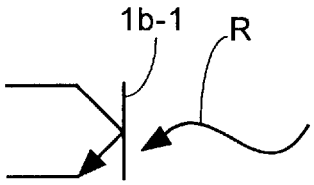
FIG. 2A is a partial schematic diagram of the supervision circuitry of the module of FIG. 2.

FIG. 2A illustrates one form of a sensor 16-1, a phototransistor which changes state in response to incident radiant energy R. It will be understood that other types of radiation sensitive elements could be used in lieu of the phototransistor of FIG. 2A.

Figure 3:
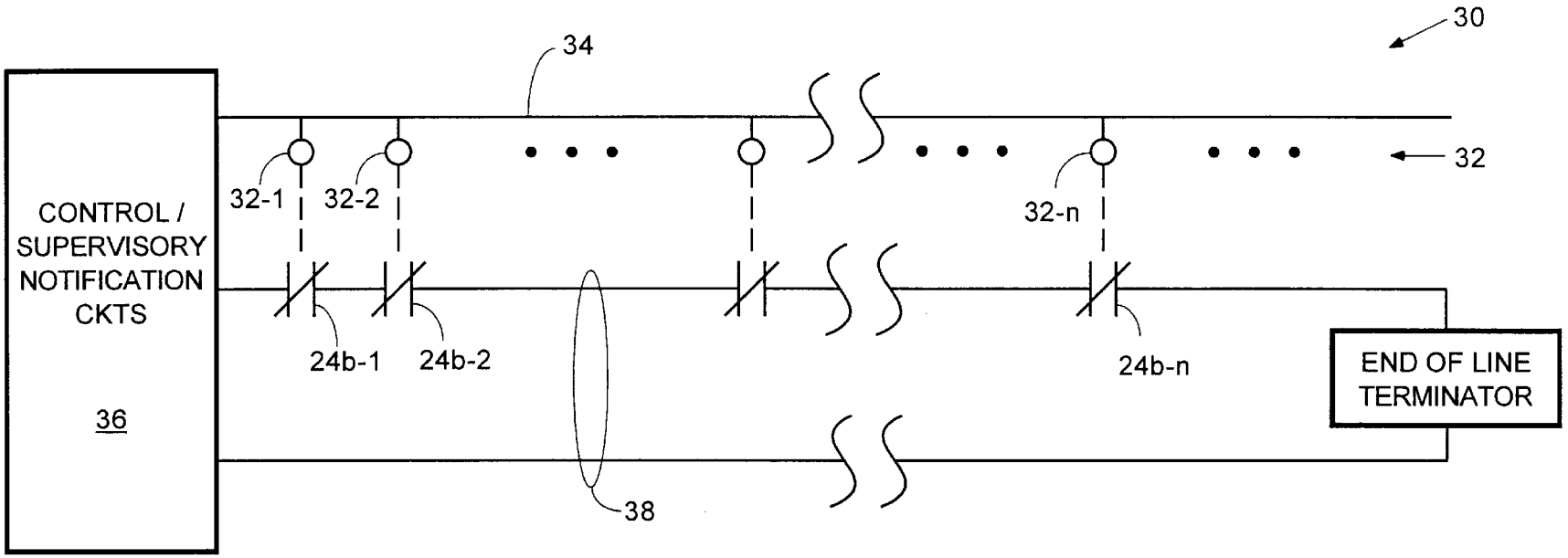
FIG. 3 is a system which includes a plurality of modules of the type illustrated in FIGS. 1 and 2.

FIG. 3 illustrates an exemplary system 30 which incorporates a plurality of electrical modules 32. In one embodiment, at least some of the modules 32 could be ambient condition detectors. For example, typical detectors would include smoke, thermal or intrusion detectors. Such detectors can be used to supervise a region of interest.

In the exemplary system 30 of FIG. 3, the plurality of modules 32 is coupled by a communication link 34 to control/supervisory circuitry 36. The circuitry 36, which could if desired include a programmable processor, includes a supervisory loop 38. The loop 38 is coupled to a plurality of normally open relay contacts, comparable to the contacts 24*b*.

The contacts on the loop 38 are connected in series. It will be understood that a variation of the loop 38 could incorporate parallel connected contacts without departing from the spirit and scope of the present invention.

So long as all of the contacts 24*b*-1 . . . 24*b*-n are held closed by the respective member of the plurality 32, the supervisory circuitry 36 will not produce any module fault indicators. In the event that a cover is removed from one of the modules 32 and that cover is not replaced before the predetermined time interval has run, the respective pair of relay contacts 24*b*-i will open circuit thereby providing an immediate indication to the supervisory circuits 36 that one of the members of the plurality 32 is exhibiting a trouble or fault condition.

It will be understood that instead of a separate loop 38, the link 34 could be used by the plurality of modules 32 to communicate a trouble or fault in the indicator to the supervisory circuitry 36 without departing from the spirit and scope of the present invention. In such an instance, it might also be possible to identify the particular member of the plurality 32 which has transmitted the fault or trouble indication.

Figure 4A:
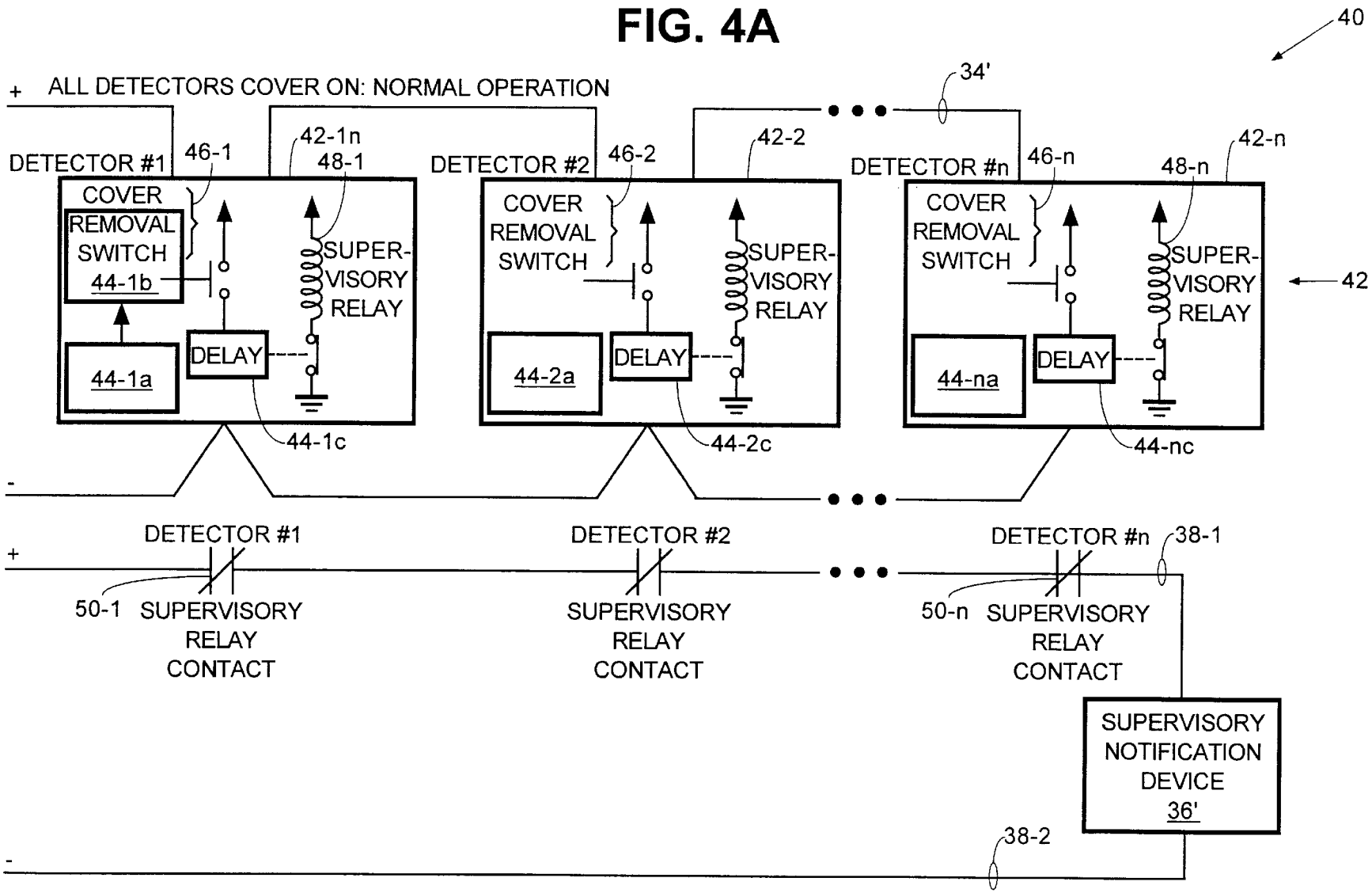
FIG. 4A is an electrical block diagram illustrating more details of a system of the type illustrated in FIG. 3.
Figure 4B:
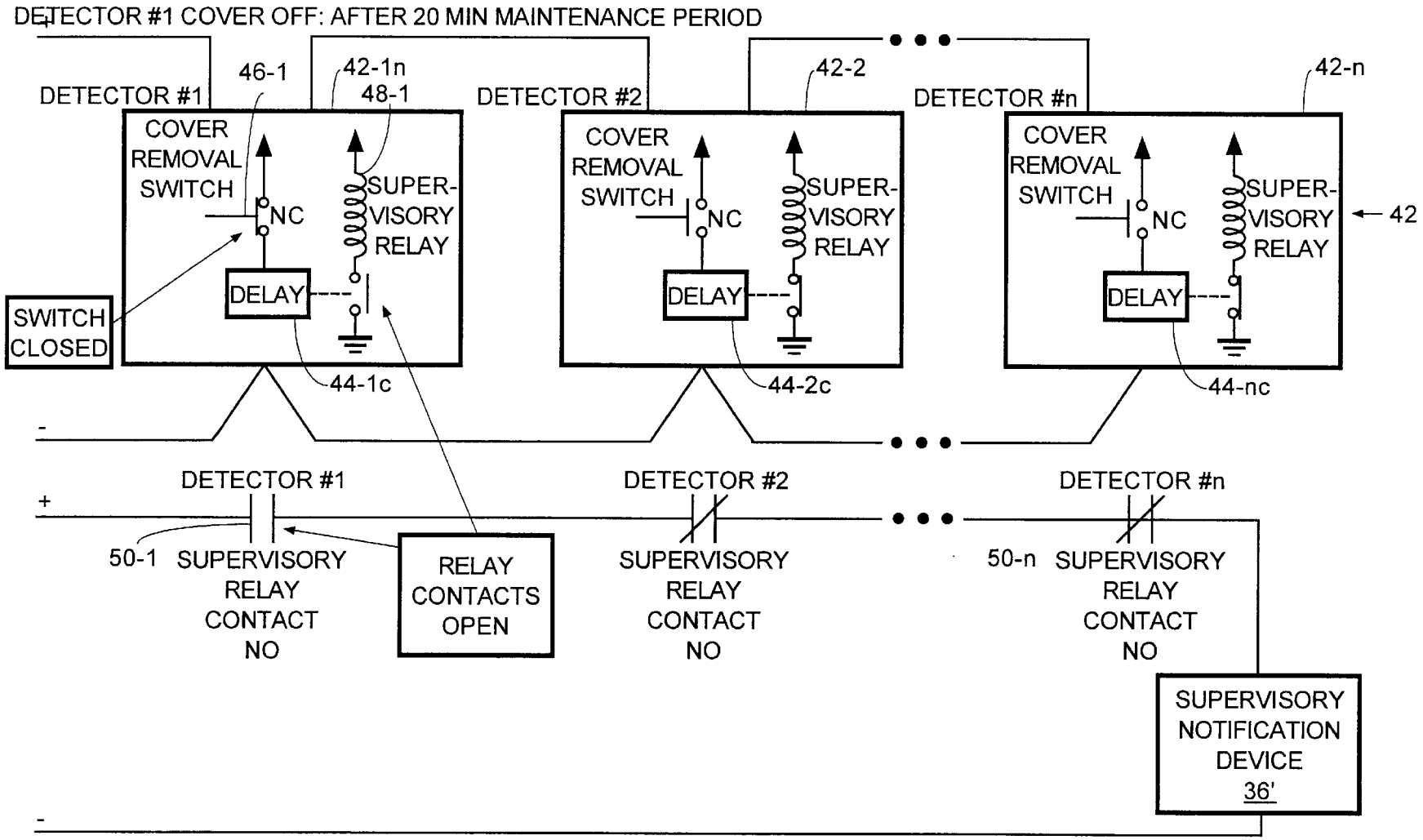
FIG. 4B is an electrical block diagram illustrating the configuration of the system of FIG. 4A indicating a potential fault.

FIGS. 4A and 4B illustrate an exemplary system 40 which includes a plurality of modules 42. In the system 40, the modules 42 could, for example, be implemented as ambient condition detectors such as smoke detectors. In such an event, the members of the plurality 42 would each incorporate a smoke sensor such as the exemplary sensors 44-1*a* . . . 44-n*a*. Each of the members of the plurality 42 includes control circuitry such as the circuitry 44-lb which includes delay circuitry 441*c*.

Each of the members of the plurality 42 includes a cover removal detection sensor or switch corresponding to the switches 46-1 . . . 46-n. As discussed previously with respect to sensor 16, removal of the respective cover causes the respective switch to change state, close or open circuit, and trigger the respective delay circuit 44-1*c* . . . 44-n*c*.

If the respective cover is replaced on the respective module before the delay interval terminates, energy will continue to be supplied to the respective supervisory relay such as the relays 48-1 . . . 48-n. This in turn continues to hold the respective contacts such as the contacts 50-1 . . . 50-n closed.

In the event that the respective cover is not replaced within the predetermined delay interval, the circuitry 44-1*b* and 44-1*c*, for example, will disable the respective supervisory relay coil 48-1. In response thereto, the respective contacts 50-1 will assume their normally open state thereby interrupting flow of current in the loop 38-1, -2. Hence, the supervisory circuitry 36 will become aware of the fault or trouble indicator. Where the respective cover is replaced on the respective unit during the delay interval, the respective delay element, such as 44-1*c* is reset thereby causing the respective supervisory relay such as 48-1 to continue to be energized, hence holding the respective contacts 50-1 in the closed state.

For exemplary purposes only, the system 40 has been illustrated as a four wire-type detector system as would be known to those of skill in the art. It will be understood that the particular form of communication link 34 and supervisory link 38-1, -2 are not limitations of the present invention. The detectors could without limitation be smoke detectors.

FIG. 4B illustrates the system 40 after a delay circuit, such as a delay circuit 44-1*c* has timed out in response to a respective cover having been removed. As illustrated in FIG. 4B, relay contacts 50-1 have assumed an open state in response to the current through the respective supervisory relay coil 48-1 having been interrupted by the module control circuitry 44-1*b* and delay circuitry 44-1*c*. Hence, the supervisory notification device 36' which could correspond to the supervisory circuitry 36 or could correspond to another relay with an output device such as a horn or a visible alarm is now able to produce a trouble or fault indicator.

The system 40 can be used with alarm system control panels, such as the supervisory and control circuitry 36. Alternately, the system 40 can be used in the stand alone mode with a separate fault or alarm indicator 36'.

It will be also understood that the plurality of modules 32 could correspond to two wire ambient condition detectors which are capable of communicating signals to the control and supervisory circuitry 36. In such an instance, a solid state switch can be used to provide a fault or trouble indication on a separate loop. Alternately, a message can be transmitted to the control supervisory circuitry 36 via the link 34.

It will be understood that neither the form of communication with the supervisory circuitry nor the use of a common control element, such as control supervisory circuits 36 or stand alone supervisory circuitry 36' are limitations of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A tamper detection apparatus for use in an electrical module which has an access port closed by a removable element comprising:

a supervisory sensor for detecting removal of the element;

a delay circuit, coupled to the sensor, for generating an output signal a predetermined time interval after removal of the element wherein the output signal is indicative of the element's not being replaced on the module during the time interval.

2. An apparatus as in claim 1 wherein the delay circuit includes a resettable timer.

3. An apparatus as in claim 2 wherein the module comprises a smoke detector with a removable cover and wherein the cover is coupled to the sensor until the cover is removed from the detector.

4. An apparatus as in claim 1 wherein the sensor includes a switch having movable metallic contacts and wherein the contacts change state in response to removal of the element from the module.

5. An apparatus as in claim 4 wherein the switch comprises a reed relay.

6. An apparatus as in claim 1 wherein the sensor comprises a sensor of radiant energy and wherein removal of the element is detected by a change in radiant energy incident on the sensor.

7. An apparatus as in claim 6 which includes an emitter of radiant energy wherein the sensor generates an output signal in response to incident radiant energy.

8. An apparatus as in claim 1 wherein the delay circuit includes an input responsive to a signal from the sensor indicating removal of the cover which initiates the delay interval and an input indicative of replacement of the element whereupon the delay interval will be terminated.

9. An apparatus as in claim 1 which includes a housing which defines an internal region and whereon the sensor is carried by the housing.

10. An apparatus as in claim 9 wherein the housing carries a transducer.

11. An apparatus as in claim 10 wherein the transducer includes a fire sensor.

12. An apparatus as in claim 10 wherein the housing is configured to be duct mountable.

13. An apparatus as in claim 12 wherein the fire sensor includes a smoke detecting element.

14. An apparatus as in claim 12 wherein the supervisory sensor includes at least one metallic contact which moves in response to removal of the removable element.

15. A supervised electrical module comprising:

a housing;

an attachment removably affixed to the housing;

attachment removal detection circuitry carried by the housing for generating an indication of a removal of the attachment;

circuitry, coupled to the detection circuitry, for initiating a timing interval in response to the generated indication; and circuitry for generating a supervisory signal indicative of the attachment's having been removed if the attachment is not replaced before the expiration of the timing interval.

16. A module as in claim 15 which includes a transducer carried by the housing.

17. A module as in claim 16 wherein the transducer includes an ambient condition sensor.

18. A module as in claim 17 wherein the sensor comprises a smoke sensor.

19. A module as in claim 15 wherein the detection circuitry includes at least one metal contact that is deflectable in response to removal of the attachment.

20. A module as in claim 15 wherein the detection circuitry includes a sensor of a degree or radiant energy incident thereon, which changes in response to removal of the attachment.

21. A module as in claim 19 wherein the metal contact is part of a mechanically operable switch.

22. A module as in claim 19 wherein the metal contact is part of a reed relay.

23. A module as in claim 15 wherein the initiating circuitry includes electronic timing circuitry.

24. A module as in claim 23 wherein the timing circuitry includes a digital timer.

25. A module as in claim 15 wherein the attachment comprises a cover for closing at least a portion of the housing.

26. A module as in claim 25 which carries an ambient condition sensor within the housing.

27. A module as in claim 25 wherein the detection circuitry includes a two-state switch coupled to the cover, when attached, wherein removal of the cover results in the switch going from one state to another state.

* * * * *